United States Patent [19]

McRitchie

[11] 4,175,746

[45] Nov. 27, 1979

[54] GAME APPARATUS WITH FENCE-LIKE BOUNDARY DEFINING MEMBERS

[76] Inventor: Charles A. McRitchie, 49700 Cross St., Belleville, Mich. 48111

[21] Appl. No.: 897,817

[22] Filed: Apr. 19, 1978

[51] Int. Cl.[2] ..... A63B 67/04

[52] U.S. Cl. ..... 273/85 R

[58] Field of Search ..... 273/1.5 R, 1.5 A, 85 R, 273/95 R, 95 A, 105 R

[56] References Cited

U.S. PATENT DOCUMENTS

| | | | |
|---|---|---|---|
| 642,903 | 2/1900 | Hachmuth | 273/105 R |
| 849,974 | 4/1907 | Cantrell | 273/309 X |
| 1,064,914 | 6/1913 | Jones | 273/85 R UX |
| 2,201,560 | 5/1940 | Nelson | 273/85 R |
| 2,497,925 | 2/1950 | Bergerioux | 273/95 A |
| 3,689,069 | 9/1972 | Rogers | 273/85 R |
| 3,762,708 | 10/1973 | Hing | 273/95 A |
| 3,966,208 | 6/1976 | Gohsler | 273/95 A X |

*Primary Examiner*—Anton O. Oechsle

*Attorney, Agent, or Firm*—Edward M. Apple

[57] ABSTRACT

Game apparatus for playing a simulated game of basketball, consisting of a round playing field divided into an offensive area and a defensive area, with removable elevated restrictive fence-like members defining the outside boundary of each area and with a removable elevated back board and basket assembly along the outer periphery of the defensive area.

3 Claims, 3 Drawing Figures

GAME APPARATUS WITH FENCE-LIKE BOUNDARY DEFINING MEMBERS

An object of the invention is to provide a game of skill which can be participated in by all members of the family, young and old alike.

Another object of the invention is to provide a game of action, in which the players may dribble, pass, rebound and shoot according to their respective abilities.

Another object of the invention is to provide a playing field which is divided into an offensive area and a defensive area, with predetermined fence-like members, which restrict the movements of the players and add physical impediments to the free flow of the game.

Another object of the invention is to provide game apparatus with fence-like members which limit the reach of the players in action.

Another object of the invention is to provide game apparatus which can be adjusted and removed from the playing field so that the field may be used as a card table or the like.

The foregoing and other objects and advantages of the invention will become more apparent as the description proceeds, reference being made from time to time to accompanying drawings forming parts of the within disclosure in which drawings.

Figure 1:
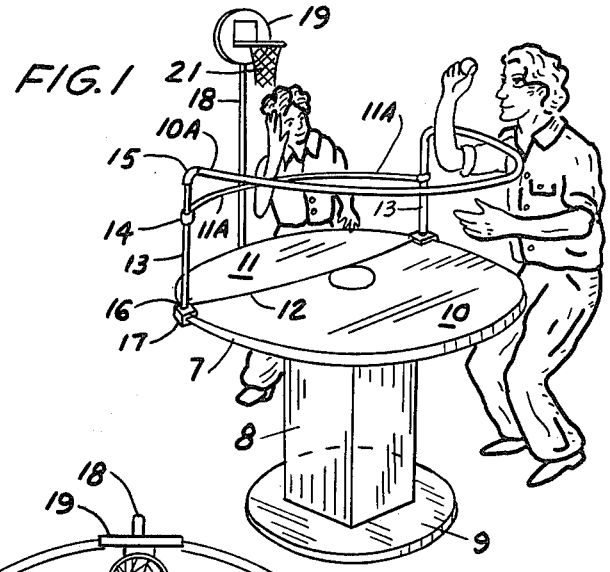
FIG. 1, is a perspective view of the game apparatus being used by an adult and a teenager in a game of table basketball.
Figure 2:
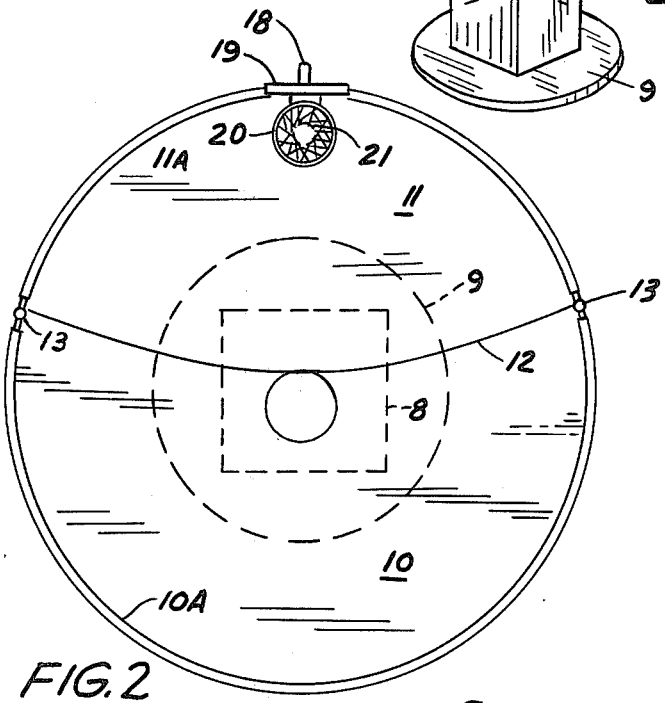
FIG. 2, is an enlarged plan view of the game apparatus without the players
Figure 3:
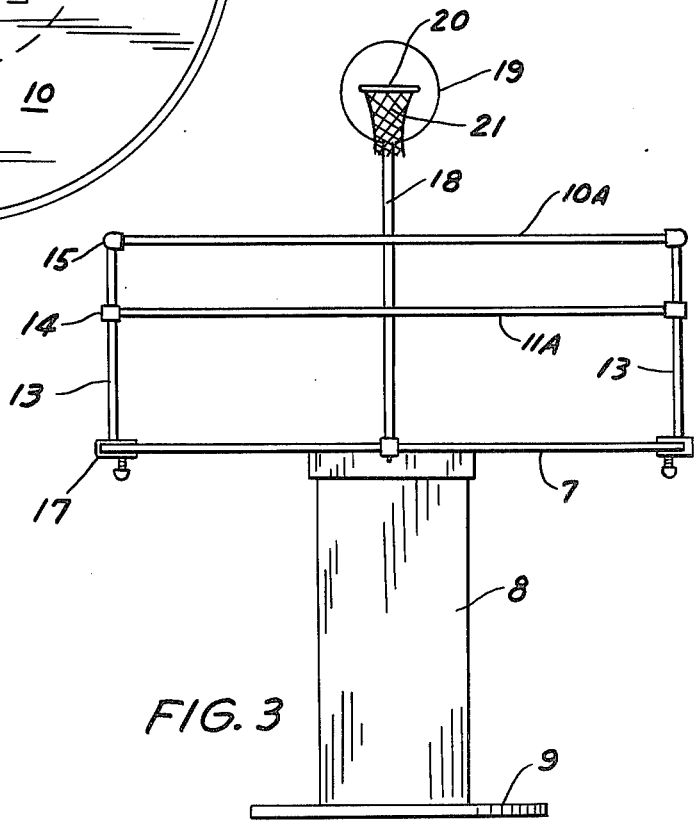
FIG. 3 is a side elevation of the game apparatus shown in FIG. 2.

Referring now more particularly to the drawings it will be understood that in the embodiment herein disclosed the reference character (7), indicates the circular playing field, which is in the form of a table top which is supported by a pedestal (8) and a base (9). These elements may be made of plywood, plastic or other suitable material. The playing field in this embodiment is approximately 48 inches in diameter and is divided into an offensive area (10) and a defensive area (11), which areas are separated by a stripe (12), which is painted on the top (7) or marked with a colored tape or the like.

The outer periphery of each area (10) and (11), is further defined by an elevated fence-like member (10A) and (11A), which are bent tubular elements, supported by common stantions (13). The member (10A) is approximately seventeen inches high above the playing field and the member (11A) is approximately eleven inches high. The members (10A) and (11A) may be made of aluminum or plastic tubing, or may even be made of metal pipe, and assembled with plumbers tees (14) and elbows (15) and base flanges (16), which may be obtained on the open market. This assembly is preferably secured to the table top (7) by C-Clamps (17) or the like. Secured in the approximate peripheral center of the defensive area (11) is a removable upright (18) which supports a back board (19), a ring (20), and a net (21) which completes the apparatus.

The game is preferably played with a soft rubber ball about the size of a tennis ball and the rules of conventional basketball may be followed with modifications to suit.

In any event the players may dribble, pass, rebound and shoot as in a real contest of basketball, keeping in mind that the players arms must remain at all times, under the restrictive fence-like members (10A) and (11A), as the game progresses. The playing time, point value of baskets scored, fouls and other rules may be varied at will.

A typical game is played as follows. The offensive player to start may be chosen in any manner. He assumes a position along the area (10) and his opponent positions himself along the area (11). Both players should start the game with one hand on the table and the other below the restrictive member (10A) or (11A). The offensive player drops the ball over the member (10A) and the game is on, each player competing for the ball. The offensive player dribbles the ball with either hand or he may pass the ball from one hand to the other and may shoot from any position in the offensive area (10). The defensive player tries to prevent the shot and tries to get his hands on the ball. If he gets the ball he then becomes the offensive player and moves around the table from area (11) to area (10), where the game continues. If a basket is made a score of two points is added. If a basket is missed or one is made the ball changes hands. If a ball does not touch the back board on a shot it goes to the other player. Fouls are called if a player touches the other. The player fouled gets a free throw. He may throw from above the fence-like member, otherwise all playing is done with hands below the fence. The game continues until a predetermined number of points are scored or the agreed upon playing time runs out.

Having described my invention what I claim and desire to secure by Letters Patent is:

1. Game apparatus consisting of an elevated circular playing field divided into an offensive area and a defensive area, removable fence-like members defining the outer boundary of each area, and a removable backboard and basket assembly mounted at a point in the said defensive area, in which the fence-like member defining the outer boundary of the offensive area is higher than the member defining the outer boundary of the defensive area.

2. The structure of claim 1, in which the fence-like member of the offensive area is longer than that of the defensive area.

3. The structure of claim 1, in which the said fence-like members are supported by common upright members, which are clamped to the periphery of the circular playing field.

* * * * *